US010085524B2

(12) United States Patent
Fleming

(10) Patent No.: US 10,085,524 B2
(45) Date of Patent: Oct. 2, 2018

(54) HOOK AND LOOP FASTENER

(71) Applicant: Jeffery William Thomas Fleming, Vernon (CA)

(72) Inventor: Jeffery William Thomas Fleming, Vernon (CA)

( * ) Notice: Subject to any disclaimer, the term of this patent is extended or adjusted under 35 U.S.C. 154(b) by 0 days.

(21) Appl. No.: 15/657,481

(22) Filed: Jul. 24, 2017

(65) Prior Publication Data

US 2018/0020783 A1 Jan. 25, 2018

Related U.S. Application Data

(60) Provisional application No. 62/366,217, filed on Jul. 25, 2016.

(51) Int. Cl.

| | |
|---|---|
| ***A44B 19/00*** | (2006.01) |
| ***A44B 19/16*** | (2006.01) |
| ***A44B 19/26*** | (2006.01) |
| *A44B 19/36* | (2006.01) |

(52) U.S. Cl.

CPC ..... *A44B 19/16* (2013.01); *A44B 19/26* (2013.01); *A44B 19/267* (2013.01); *A44B 19/36* (2013.01); *Y10T 24/25* (2015.01); *Y10T 24/2561* (2015.01); *Y10T 24/26* (2015.01)

(58) Field of Classification Search

CPC ... A44B 19/16; A44B 19/267; Y10T 24/2532; Y10T 24/2534

See application file for complete search history.

(56) References Cited

U.S. PATENT DOCUMENTS

| | | | | |
|---|---|---|---|---|
| 3,387,345 | A | 6/1968 | Savoir | |
| 4,426,816 | A | 1/1984 | Dean et al. | |
| 4,531,634 | A | 7/1985 | Jung-Chi | |
| 5,171,253 | A | 12/1992 | Klieman | |
| 6,678,898 | B2 | 1/2004 | Jones et al. | |
| 7,753,686 | B2 | 7/2010 | Kim et al. | |
| 8,191,170 | B2 | 6/2012 | Ehlmé | |
| 2005/0067041 | A1 | 3/2005 | Cheng | |
| 2006/0107500 | A1* | 5/2006 | Meager | A44B 19/16 24/399 |
| 2009/0108968 | A1 | 4/2009 | Tsai et al. | |
| 2010/0269312 | A1 | 10/2010 | Wagner et al. | |
| 2011/0214262 | A1 | 9/2011 | Van Gansen | |
| 2014/0366336 | A1* | 12/2014 | Chung | A44B 19/32 24/389 |

* cited by examiner

*Primary Examiner* — Robert Sandy
*Assistant Examiner* — Michael S Lee
(74) *Attorney, Agent, or Firm* — Davis & Bujold PLLC; Michael J. Bujold

(57) ABSTRACT

A hook and loop fastener includes a first strip having one of loops or hooks and a second strip having another of the loops or the hooks. The first strip has a first longitudinal track orthogonal to the first strip. The second strip has a second longitudinal track, orthogonal to the first longitudinal track. A slider is provided that has an interface disrupting member extends outwardly. A gripping element is provided for manually moving the slider along the first longitudinal track and the second longitudinal track in a first direction and a second direction. Movement of the slider in the first direction brings the first strip into engagement with the second strip. Movement of the slider in the second direction draws the interface disrupting member through the interface between the first strip and the second strip, thereby separating the first strip and the second strip.

6 Claims, 7 Drawing Sheets

HOOK AND LOOP FASTENER

FIELD

The invention relates generally to a hook and loop fastener that works like a zipper.

BACKGROUND

Currently there are a number of fastener solutions used for clothing, shoes and luggage closures. One of these solutions is a zipper, which has meshing teeth that are engaged and disengaged by use of a slider. Another solution is a hook and loop style fastener, which has a one strip of material bearing multiple loops and another strip of material bearing multiple hooks that engage the multiple loops.

SUMMARY

There is provided a hook and loop fastener that includes a first strip having one of loops or hooks and a second strip having another of the loops or the hooks. The first strip has a first longitudinal track orthogonal to the first strip. The second strip has a second longitudinal track, orthogonal to the first longitudinal track. A slider is provided having a body with a first receiver for receiving the first longitudinal track and a second receiver for receiving the second longitudinal track. An interface disrupting member extends outwardly from the body parallel to the second strip at an interface between the first strip and the second strip. A gripping element is provided for manually moving the slider along the first longitudinal track and the second longitudinal track in a first direction and a second direction. Movement of the slider in the first direction brings the first strip into alignment in preparation for engagement with the second strip. Movement of the slider in the second direction draws the interface disrupting member through the interface between the first strip and the second strip, thereby separating the first strip and the second strip.

As described above, the hook and loop fastener works similar to a zipper, which provides an easy way to use hook and loop fasteners in the place of zippers. The fastener aligns and closes hook and loop fasteners, made known under the Trademark "VELCRO", with a pull of a slider. The interface disrupting member of the fastener separates the hook and loop fasteners, when the slider is pulled in the opposite direction. It will be apparent that the above described fasteners has as many applications as a traditional zipper does: bags, shoes, jackets, clothing and many more.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
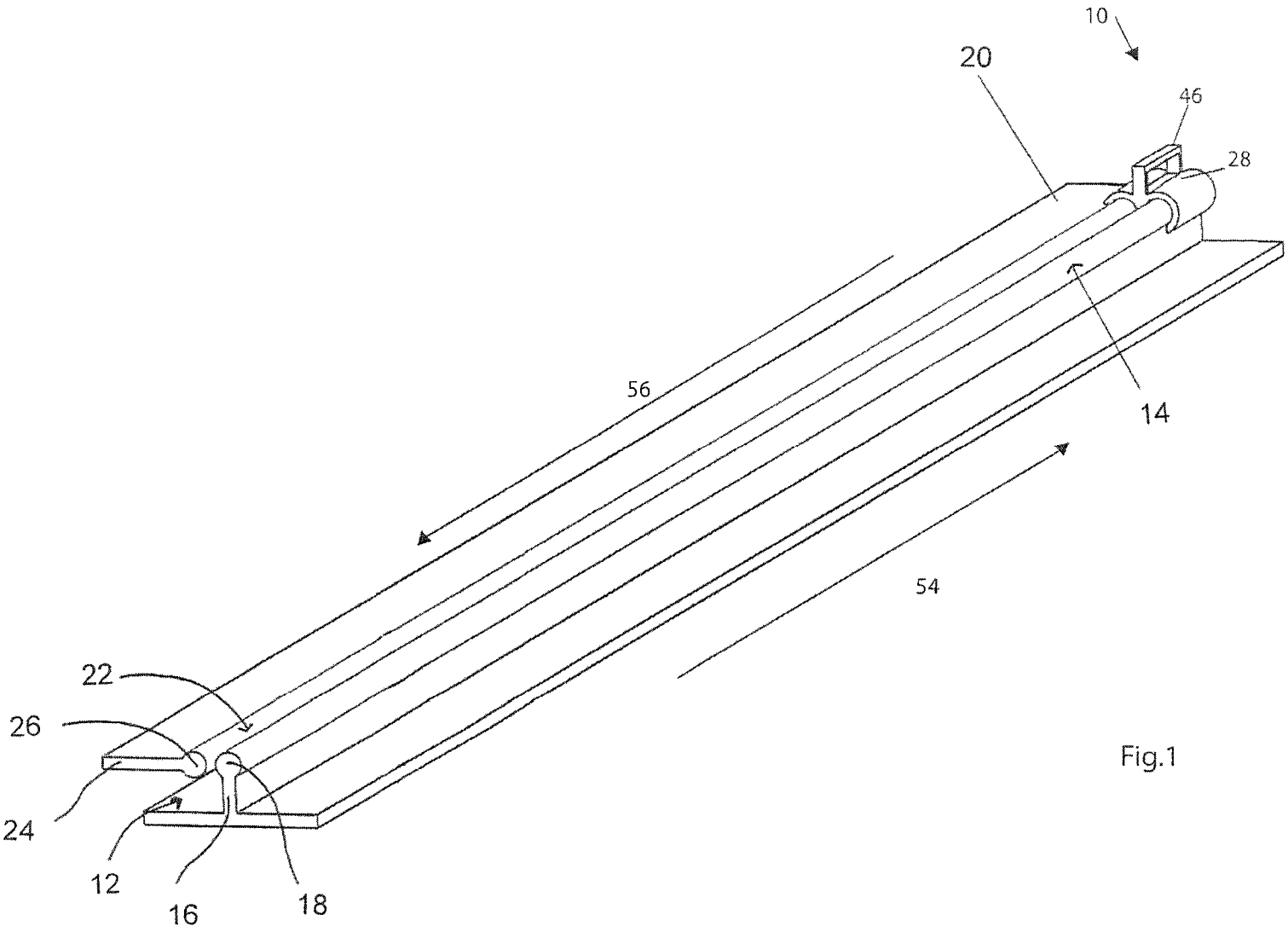
FIG. 1 is a perspective view of a hook and loop fastener.

A hook and loop fastener, generally identified by reference numeral 10, will now be described with reference to FIG. 1 through FIG. 7.

Figure 2:
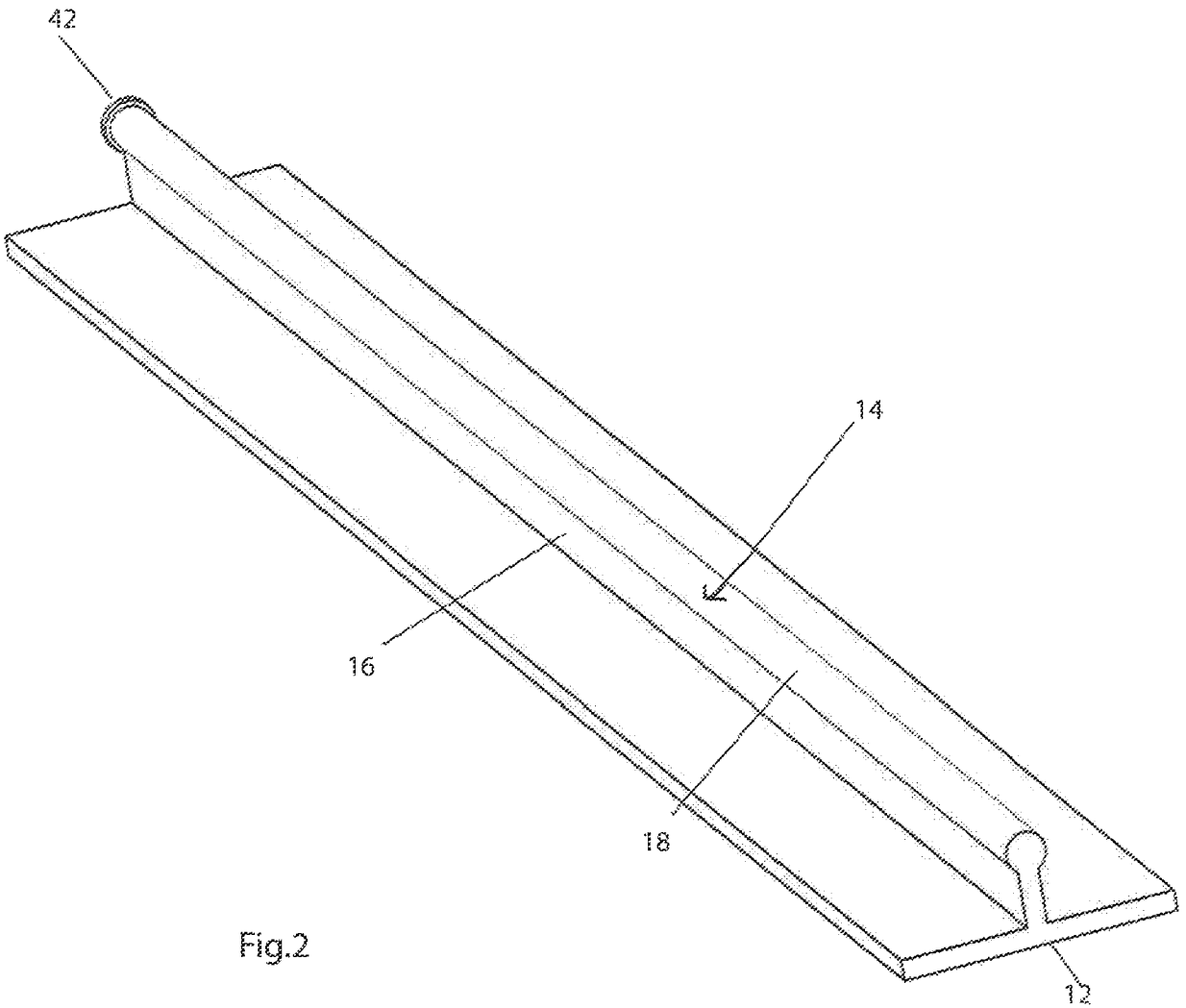
FIG. 2 is a perspective view of a first longitudinal track used with the hook and loop fastener of FIG. 1.
Figure 3:
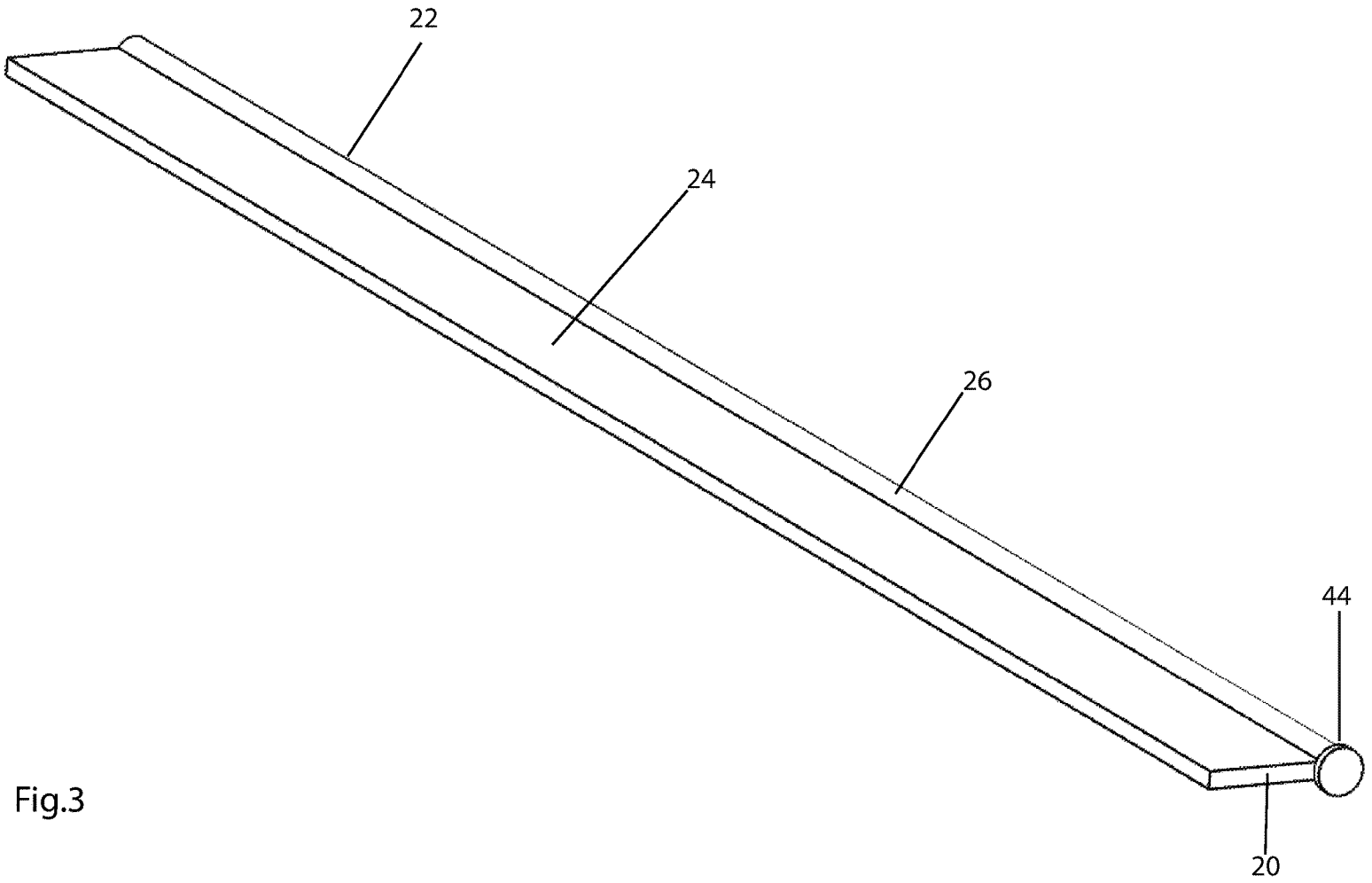
FIG. 3 is a perspective view of a second longitudinal track used with the hook and loop fastener of FIG. 1.
Figure 6:
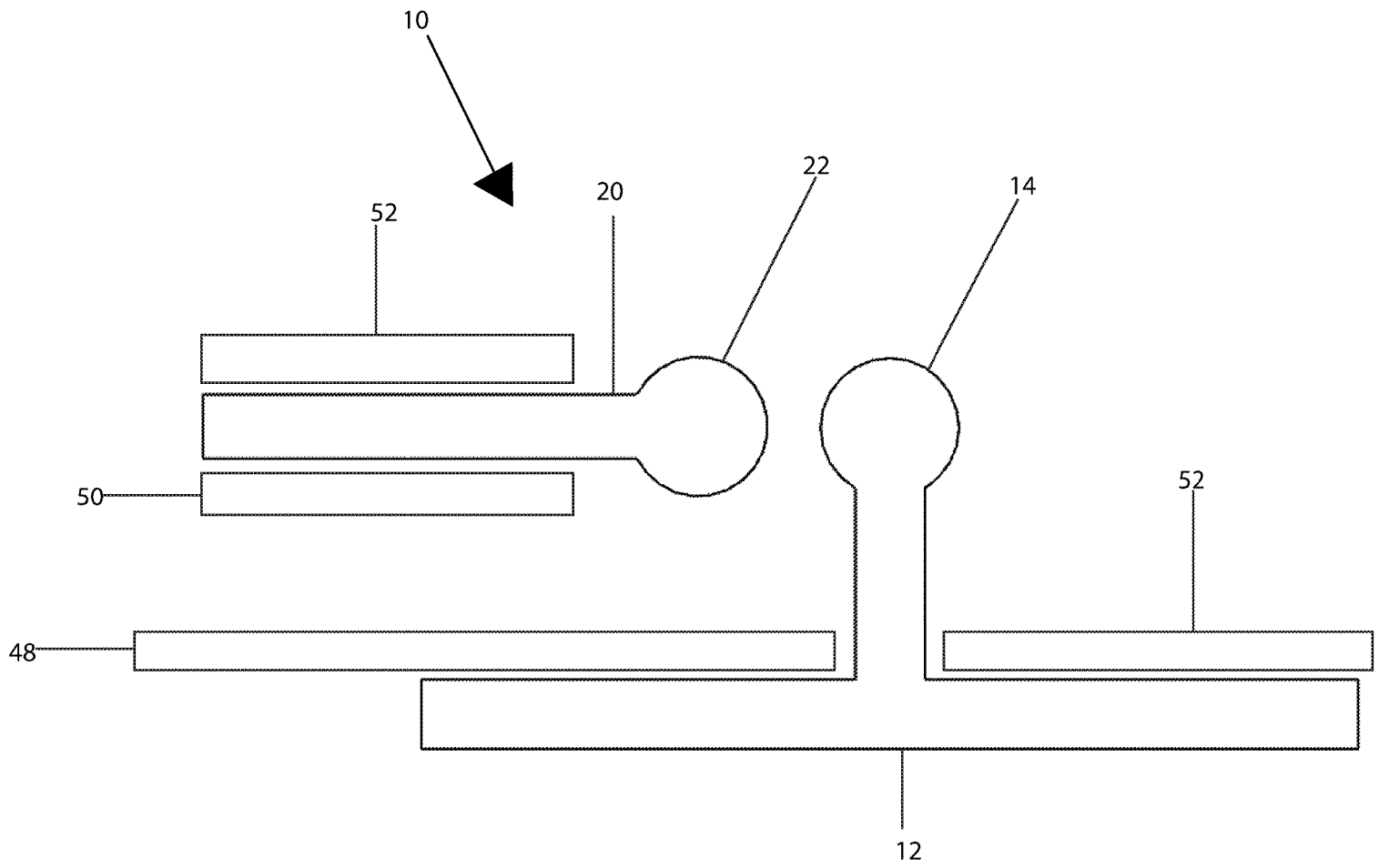
FIG. 6 is an exploded section view, taken along section lines 6-6 of FIG. 1.

Structure and Relationship of Parts:

Referring to FIG. 6, fastener 10 includes a first strip 12 having one of loops or hooks, and having a first longitudinal track 14 orthogonal to first strip 12. Referring to FIG. 2, first longitudinal track 14 has a track support 16 with a bulbous end 18. Referring to FIG. 6, fastener 10 also includes a second strip 20 having another of the loops or the hooks, and having a second longitudinal track 22, orthogonal to first longitudinal track 14. Referring to FIG. 3, second longitudinal track 22 also has a track support 24 with a bulbous end 26.

Figure 4:
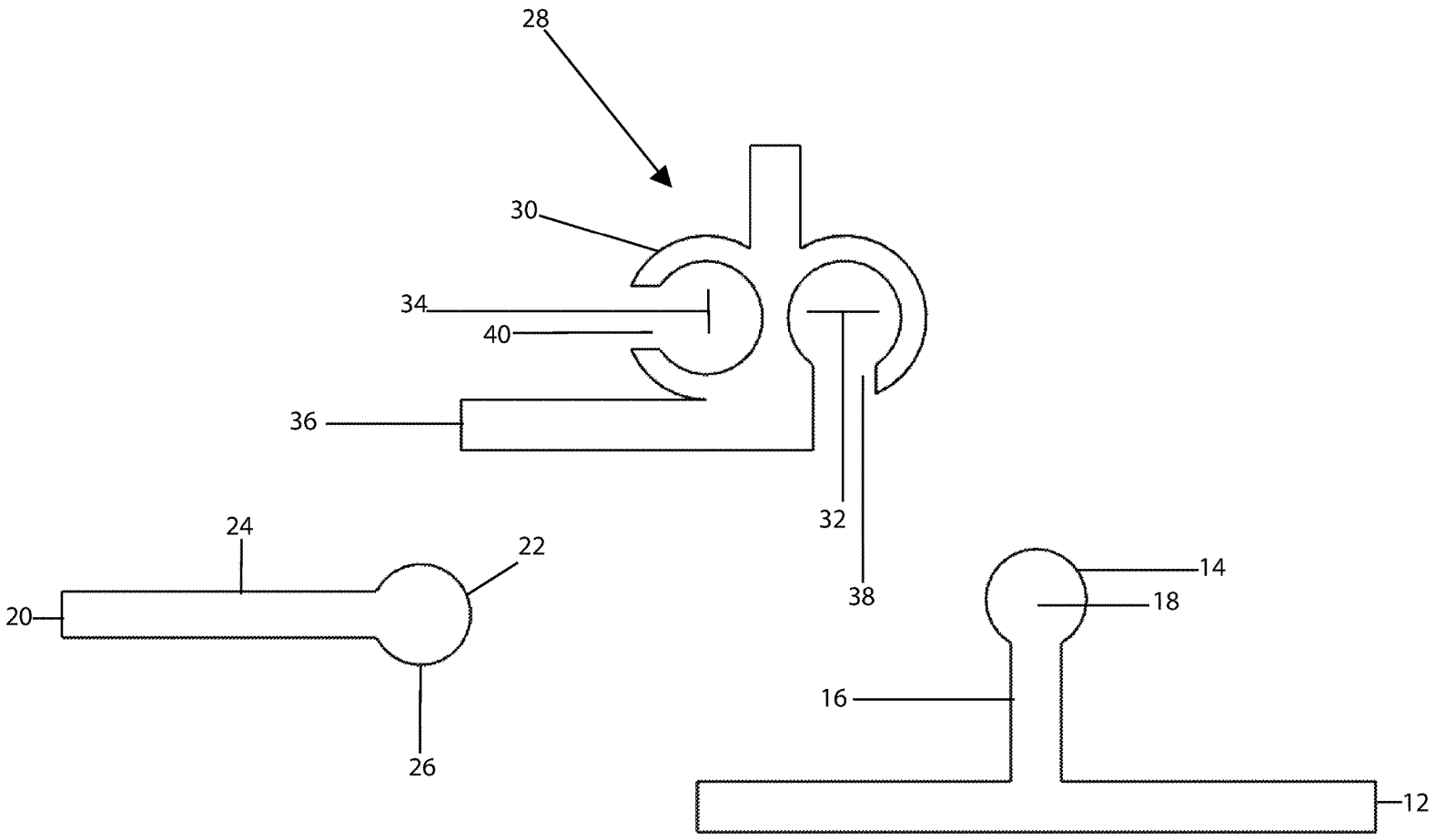
FIG. 4 is an end elevation view of a slider used with the hook and loop fastener of FIG. 1.
Figure 5:
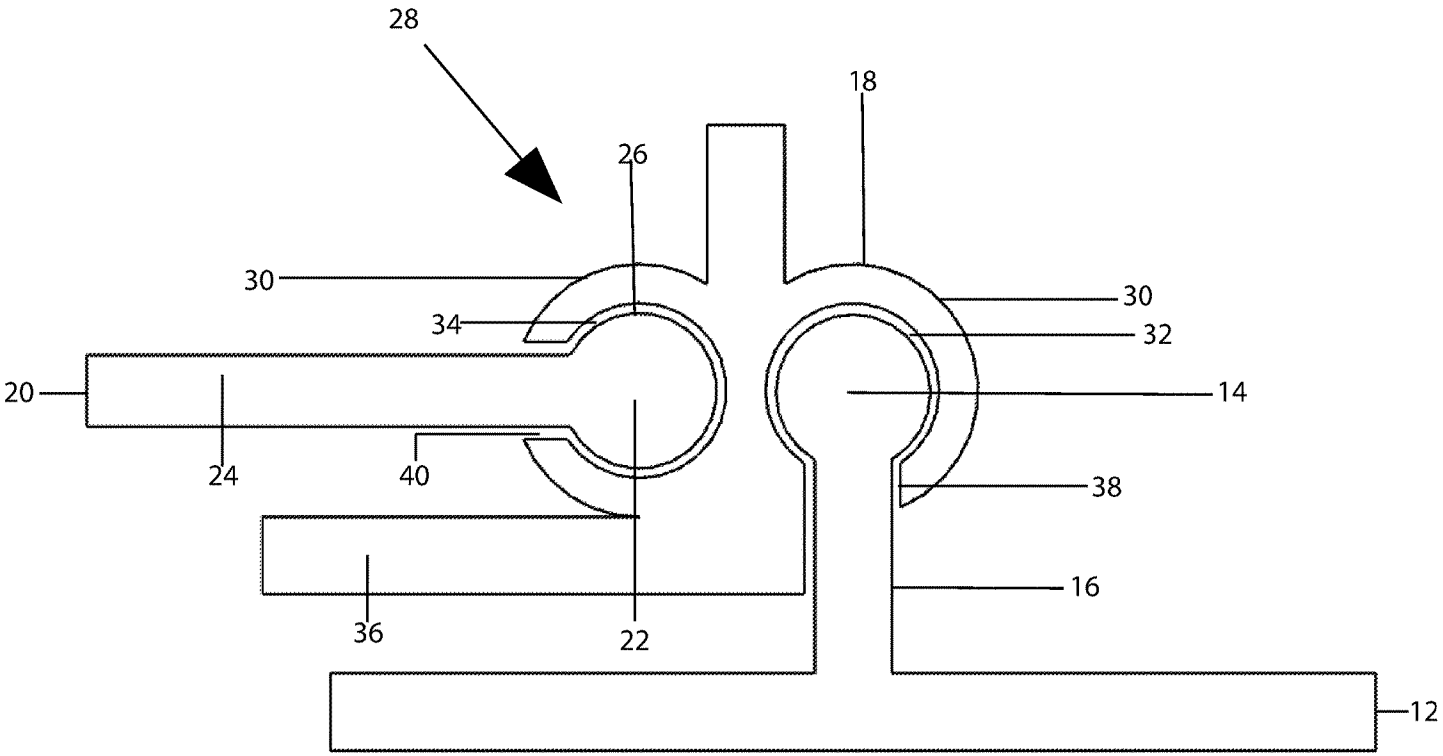
FIG. 5 is an end elevation view of the illustrated in FIG. 4, engaged with the first longitudinal track illustrated in FIG. 2 and the second longitudinal track illustrated in FIG. 3.
Figure 7:
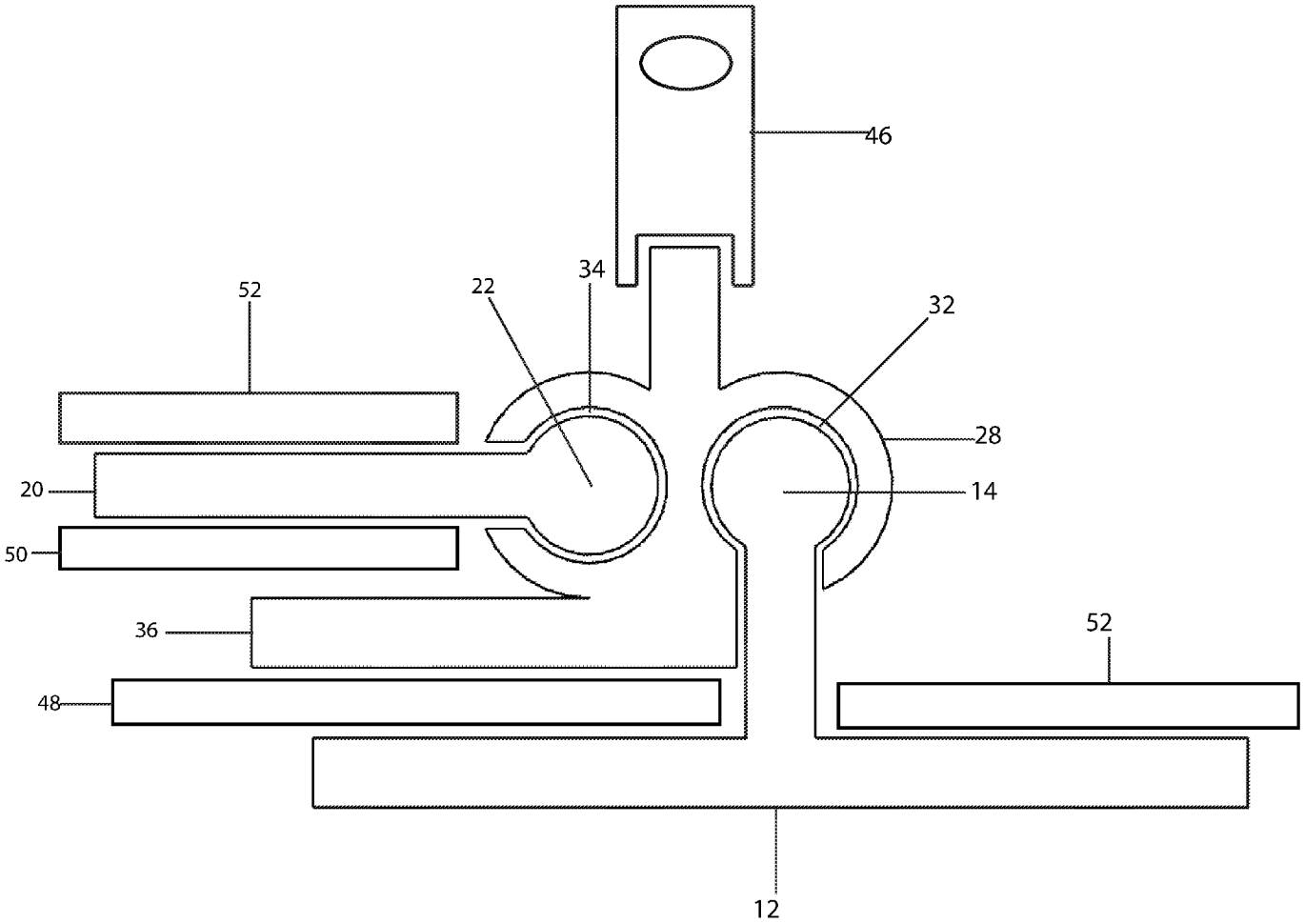
FIG. 7 is a section view, taken along section lines 7-7 of FIG. 1.

Referring to FIG. 4 and FIG. 5, a slider 28 is provided having a body 30 with a first receiver 32 in the shape of a hollow cylindrical tube or barrel for receiving first longitudinal track 14, a second receiver 34 also in the shape of a hollow cylindrical tube or barrel for receiving second longitudinal track 22. An interface disrupting member 36, in the form of a dull blade, extends outwardly from body 30. Referring to FIG. 7, interface disrupting member 36 is positioned parallel to second strip 20 at an interface between first strip 12 and second strip 20. Referring to FIG. 4 and FIG. 5, first receiver 32 receives first longitudinal track 14 and has a longitudinal slot 38 large enough to accommodate track support 16 but not large enough to allow bulbous end 18 to exit the hollow cylindrical tube or barrel of first receiver 32 through longitudinal slot 38. Referring to FIG. 4 and FIG. 5, second receiver 34 receives second longitudinal track 22 and also has a longitudinal slot 40 large enough to accommodate track support 24 but not large enough to allow bulbous end 26 to exit the hollow cylindrical tube or barrel of second receiver 34 through longitudinal slot 40.

Referring to FIG. 2, a first end stopper 42 is provided on first longitudinal track 14. Referring to FIG. 3, a second end stopper 44 is provided on second longitudinal track 22. First end stopper 42 prevents slider 28 from sliding off and separating from first longitudinal track 14 and second longitudinal track 22 in one direction. Second end stopper 44 prevents slider 28 from sliding off and separating from first longitudinal track 14 and second longitudinal track 22 in the other direction.

Referring to FIG. 7, a gripping element 46 is provided for manually moving slider 28 along first longitudinal track 14 and second longitudinal track 22 in a first direction and a second direction.

Referring to FIG. 6 and FIG. 7, there is illustrated how first strip 12 has attached to it a loop layer 48 and second strip 20 has attached to it a hook layer 50. There is also shown the positioning of a substrate 52, such as leather for a handbag, fabric for a garment, are positioned relative to first strip 12 and second strip 20.

Operation:

Referring to FIG. 1, slider 28 is capable of movement in a first direction, indicated by arrow 54, or a second direction, indicated by arrow 56. Referring to FIG. 6, movement in first direction 54 draws first strip 12 and second strip 20 together bringing loop layer 48 of first strip 12 into alignment in preparation for engagement with hook layer 50 of second strip 20. Referring to FIG. 7, movement of slider 28 in second direction 56 draws interface disrupting member 36 through the mating interface between loop layer 48 of first strip 12 and hook layer 50 of second strip 20 thereby separating first strip 12 and second strip 20.

Variations:

It will be appreciated by persons skilled in the art that the first longitudinal track and the second longitudinal track do not have to be exactly as illustrated, as long as they can perform the described function of allowing the slider to move is the first direction and the second direction. It will be appreciated by persons skilled in the art that first receiver and the second receiver of the slider does not have to have to be exactly as illustrated, as long as they can engage the first longitudinal track and the second longitudinal track. It will be appreciated that the interface disrupting member does not have to exactly as illustrated, as long as it serves the intended function of disrupting the interface between the first strip and the second strip. The interface disrupting member could be different shapes. It will be appreciated that the gripping element used to grip and move the slider in the first direction and the second direction, does not have to be exactly as illustrated and could take different forms. In the illustrated embodiment first strip 12 has attached to it a loop layer 48 and second strip 20 has attached to it a hook layer 50. It will be appreciated that this could be reversed with first strip 12 having attached to it a hook layer 50 and second strip 20 having attached to it a loop layer 48.

Cautionary Warnings:

While the dull blade that serves as an interface disrupting element does not have to extend for the entire width of the first strip and the second strip, it must extend a sufficient distance across the first strip and the second strip to perform the function of disrupting the engagement of the hooks and the loops.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A hook and loop fastener, comprising:

a first strip having one of a hook layer or a loop layer, the first strip having a first longitudinal track orthogonal to the first strip and spaced from the hook layer or the loop layer;

a second strip having another of the hook layer or the loop layer, the second strip having a second longitudinal track, orthogonal to the first longitudinal track and spaced from the hook layer or the loop layer;

a slider having a body with a first receiver for receiving the first longitudinal track, a second receiver for receiving the second longitudinal track, and an interface disrupting member extending outwardly from the body parallel to the second strip between the hook layer and the loop layer, the slider being laterally spaced from the hook layer and the loop layer with the interface disrupting member extending for a substantial portion of a width of the hook layer and the loop layer; and a gripping element for manually moving the slider along the first longitudinal track and the second longitudinal track in a first direction and a second direction, such that movement of the slider in the first direction brings the first strip into alignment with the second strip in preparation for engagement and movement of the slider in the second direction draws the interface disrupting member between the first strip and the second strip thereby separating the hook layer and the loop layer.

2. The hook and loop fastener of claim 1, wherein the first longitudinal track and the second longitudinal track are comprised of a track support with a bulbous end.

3. The hook and loop fastener of claim 2, wherein the first receiver and the second receiver are hollow cylindrical tubes having a longitudinal slot large enough to accommodate the track support but not large enough to allow the bulbous end to exit the hollow cylindrical tubes through the longitudinal slot.

4. The hook and loop fastener of claim 1, wherein the interface disrupting member is a dull blade.

5. The hook and loop fastener of claim 1, wherein end stoppers are provided to stop the slider from separating from the first longitudinal track and the second longitudinal track.

6. A hook and loop fastener, comprising:

a first strip having one a hook layer or a loop layer, the first strip having a first longitudinal track orthogonal to the first strip, the first longitudinal track having a track support with a bulbous end and being spaced from the hook layer or the loop layer;

a second strip having another of the hook layer or the loop layer, the second strip having a second longitudinal track, orthogonal to the first longitudinal track, the second longitudinal track having a track support with a bulbous end and being spaced from the hook layer or the loop layer;

a slider having a body with a first receiver for receiving the first longitudinal track, a second receiver for receiving the second longitudinal track, and an interface disrupting member in the form of a dull blade extending outwardly from the body parallel to the second strip between the hook layer and the loop layer, the slider being laterally spaced from the hook layer and the loop layer with the interface disrupting member extending for a substantial portion of a width of the hook layer and the loop layer, the first receiver and the second receiver are hollow cylindrical tubes having a longitudinal slot large enough to accommodate the track support but not large enough to allow the bulbous end to exit the hollow cylindrical tubes through the longitudinal slot;

end stoppers to stop the slider from separating from the first longitudinal track and the second longitudinal track; and a gripping element for manually moving the slider along the first longitudinal track and the second longitudinal track in a first direction and a second direction, such that movement of the slider in the first direction brings the first strip into alignment with the second strip in preparation for engagement and movement of the slider in the second direction draws the interface disrupting member between the first strip and the second strip thereby separating the hook layer and the loop layer.

* * * * *